US005970725A

United States Patent [19]

Lee

[11] Patent Number: 5,970,725

[45] Date of Patent: Oct. 26, 1999

[54] AUTOMATIC ICE MAKER OF A REFRIGERATOR

[75] Inventor: Yong-Kweon Lee, Incheon, Rep. of Korea

[73] Assignee: Daewoo Electronics Co., Ltd., Seoul, Rep. of Korea

[21] Appl. No.: 09/031,710

[22] Filed: Feb. 27, 1998

[30] Foreign Application Priority Data

Jun. 30, 1997 [KR] Rep. of Korea ..... 97-29913

[51] Int. Cl.[6] ..... F25C 1/12

[52] U.S. Cl. ..... 62/137; 62/353

[58] Field of Search ..... 62/135, 137, 353

[56] References Cited

U.S. PATENT DOCUMENTS

| | | | |
|---|---|---|---|
| 3,745,779 | 7/1973 | Bright | 62/135 |
| 4,142,378 | 3/1979 | Bright et al. | 62/135 |
| 4,332,146 | 6/1982 | Yamazaki et al. | 62/353 |
| 4,402,194 | 9/1983 | Kuwako et al. | 62/353 |
| 5,177,980 | 1/1993 | Kawamoto et al. | 62/353 |
| 5,400,605 | 3/1995 | Jeong | 62/353 |
| 5,675,975 | 10/1997 | Lee | 62/353 |
| 5,768,899 | 6/1998 | Lee et al. | 62/353 |
| 5,881,563 | 3/1999 | Lee et al. | 62/353 |

*Primary Examiner*—William E. Tapolcai
*Attorney, Agent, or Firm*—Pillsbury Madison & Sutro LLP

[57] ABSTRACT

An automatic ice maker of a refrigerator has a housing, an ice-making container for making an ice by freezing the water making contact with the housing, a motor for generating the driving force to drive the ice-making container, the motor being accommodated in the housing and having a rotating shaft, a power transmitting apparatus for transmitting the driving force generated by the motor to the ice-making container so that the ice-making container is overturned or is returned to an initial position, a first micro switch for sending a first signal to a control unit for reversing a driving direction of the motor by making contact with the power transmitting apparatus, a second micro switch for sending a second signal to the control unit for closing an electric power applied to the motor by making contact with the power transmitting apparatus, and a third micro switch for sensing whether or not an ice cube storage bin which is disposed below the ice-making container is fully filled up with ice, and for sending a third signal to the control unit for stopping an operation of the ice maker when the ice cube storing bin is fully filled up with the ice. Since the automatic ice maker of a refrigerator controls the automatic ice maker by the plurality of the switches, it is easy to stably control the automatic ice maker, thereby decreasing the occurrence of a malfunction thereof.

15 Claims, 4 Drawing Sheets

300

AUTOMATIC ICE MAKER OF A REFRIGERATOR

BACKGROUND OF THE INVENTION

1. Field of the Invention

The present invention relates to a refrigerator, and more particularly to an automatic ice maker of a refrigerator.

2. Description of the Prior Art

Generally, a refrigerator includes a freezing compartment, a refrigerating compartment and an ice-making compartment. A cool air cooled by a cooler is distributed to each compartment by a cooling fan. The freezing compartment stores the foodstuffs to be frozen, the refrigerating compartment stores the foodstuffs at a lower temperature, and the ice-making compartment makes the ice by freezing the water. An ice maker for freezing the water is installed in the ice-making compartment. The ice-maker is an apparatus for making an ice, in which the water is supplied to an ice-making container and then the water is frozen therein, thereby discharging the ices by overturning the ice-making container by a driving apparatus.

The ice maker is disclosed in a U.S. Pat. No. 5,177,980 (issued to Akira Kawamoto et al.) and a U.S. Pat. No. 5,400,605(issued to Sung-Ki Jeong).

As illustrated in FIG. 1, an automatic ice maker of refrigerator 100 comprises a motor 110 for generating a driving force accommodated in a body 105, a gear assembly 120 for transmitting the driving force generated by the motor 110, an ice-making container 130 rotatably coupled to the gear assembly 120, an ice cube storage bin 150 for storing the ice cubes discharged from the ice-making container 130 and a sensing lever 160 for sensing an amount of the ice stored in the ice cube storage bin.

The motor 110 is accommodated in the body 105 by a plurality of fixing members 116, and a worm gear 114 is integrally formed at an end portion of a rotating shaft 112 of the motor 110. The driving force generated by the motor 110 is transmitted to the gear assembly 120 through the worm gear 114. The gear assembly 120 comprises a worm wheel gear 122, a first spur gear 124, a second spur gear 126 and a driving gear 128. The worm wheel gear 122 is meshed with the worm gear 114 of the motor 110, and the first gear 123 having a smaller diameter than the diameter of the worm wheel gear 122 is fixedly coupled to a central shaft of the worm wheel gear 122. The first spur gear 124 is meshed with the first gear 123, and a second gear 125 having a smaller diameter than the diameter of the first spur gear 124 is coupled to the central shaft of the first spur gear 124. The second spur gear 126 is meshed with the second gear 125, and a third gear 127 having a smaller diameter than the diameter of the second spur gear 126 is fixedly coupled to the central shaft of the second spur gear 126. Finally, the third gear 127 is meshed with the driving gear 128. The driving gear 128 is formed at a center thereof with a central shaft 121. The central shaft 121 is inserted into a rectangular-shaped groove 138 formed at an end portion of the ice-making container 130. The central shaft 121 has a rectangular shape for preventing the ice-making container from sliding while the ice-making container 130 is being rotated.

Also, the ice-making container 130 is rotatably coupled to a fixing plate 132 integrally formed at a side portion of the body 105. The ice-making container 130 is a vessel having a concave shape for storing the supplied water, and a concave portion 137 is divided by a compartment. A circular shaft 134 is protrudingly formed at a first side portion of the ice-making container 130, and the circular shaft 134 is rotatably inserted into a circular groove 136 formed at a side surface of the fixing plate 132. The ice-making container is formed with a rectangular-shaped groove 138 at a second side surface thereof, into which the connecting shaft 121 of the driving gear 128 is inserted.

A cam 129 is inserted into the connecting shaft 121 of the driving gear 128, and an end portion of the sensing lever 160 makes contact with the cam 129. The sensing lever 160 has a first end portion for making contact with the cam 129, a second end portion having a bending portion which is downwardly bent, and a middle portion positioned between the first end portion and the second end portion, and is formed with a pivot hole 166 through which a pivot pin 168 is penetrated, for pivotally fixing the sensing lever 160 to the body 105. The bending portion 164 of the sensing lever 164 is positioned in the ice cube storage bin 150 for sensing an amount of the ice cubes. A limit switch 140 is positioned at an upper portion of the sensing lever 160 for making contact with the sensing lever 160.

When electric power is transmitted to the motor 110, the motor 110 is rotated, so the worm wheel gear 122 meshed with the worm gear 114 of the motor 110 is rotated. Accordingly, the driving force is transmitted to the driving gear 128 through the first gear 124 meshed with the worm wheel gear 122 and through the second gear 126 meshed with the first gear 124. When the ice-making container 130 is being rotated in a clock-wise direction, the ice cubes are discharged from the ice-making container 130, so the ice cubes are stored in the ice cube storage bin 150 disposed beneath the ice-making container 130.

In addition, the cam 129 makes contact with the sensing lever 160 by means of the rotation of the driving gear 128. Accordingly, the end portion of the sensing lever 160 is downwardly moved and the other end portion of the sensing lever 160 is upwardly moved, so the end portion of the sensing lever makes contact with a terminal of the limit switch 140. Then, a signal of the limit switch is sent to a control unit and the motor 110 is reversely rotated. By a reverse rotation of the motor 110, the driving force is reversely transmitted to the ice-making container 130 with respect to the transmission described above, and the ice-making container finishes discharging the ice cubes and is returned to an initial position.

However, in the conventional automatic ice maker for a refrigerator, since the ice maker controls the motor by one limit switch, a malfunction thereof occurs frequently. Furthermore, since the power is only transmitted by the gear assembly, it is difficult to control the power transmission.

SUMMARY OF THE INVENTION

Accordingly, the present invention is contrived to solve the foregoing problems, and an object of the present invention is to provide an automatic ice maker of a refrigerator capable of easily controlling a power transmission, and of decreasing the malfunction thereof.

In order to achieve the above object, the present invention is provided with an automatic ice maker of a refrigerator comprising:

a housing;

an ice-making container for making an ice by freezing the water, the ice-making container being attached to the housing;

a motor for generating the driving force to drive the ice-making container, the motor being accommodated in the housing and having a rotating shaft;

a power transmitting apparatus for transmitting the driving force generated by the motor to the ice-making container so that the ice-making container is overturned or is returned to an initial position;

a first micro switch for sending a first signal to a control unit for reversing a driving direction of the motor by making contact with the power transmitting apparatus;

a second micro switch for sending a second signal to the control unit for closing an electric power applied to the motor by making contact with the power transmitting apparatus; and a third micro switch for sensing whether or not an ice cube storage bin which is disposed below the ice-making container is fully filled up with ice, the third micro switch sending a third signal to the control unit for stopping an operation of the ice maker when the ice cube storing bin is fully filled up with the ices.

According to the present invention, the power transmitting apparatus is accommodated in the housing. The power transmitting apparatus comprises a worm gear integrally formed at an end portion of the rotating shaft of the motor, a screw shaft integrally formed at a predetermined portion thereof with a worm wheel gear meshing with the worm gear, a rack coupled to the screw shaft for reciprocating in forward and backward directions according to rotational directions of the screw shaft, a pinion gear disposed on the rack and being meshed with the rack in such a manner that the pinion gear is idly rotated while the rack carries out the reciprocating movement, and a driving gear rotatably meshed with the pinion gear and having a central shaft coupled to the ice-making container.

The rack is formed at an inner portion of a first end thereof with an internal thread, and the one end of the screw shaft is rotatably meshed with the internal thread. The housing is provided at an inner wall thereof with a pair of supporting brackets which are integrally formed with and protrude from the inner wall, for rotatably supporting the power transmitting apparatus. The worm wheel gear is provided between the pair of supporting brackets. And the pair of washers are provided between the worm wheel gear and the pair of supporting brackets for facilitating a rotation of the worm wheel gear. A protruding portion is formed at a second end portion of the rack which is opposite to the first end portion of the rack. The protruding portion makes contact with the first micro switch.

The first micro switch includes a micro switch attached to the side wall of the housing and connected to the control unit, and a sensing plate which operates the micro switch when the sensing plate makes contact with the protruding portion of the rack. A guide member is fixed to a side wall of the housing for stably guiding the reciprocating movement of the rack. The guide member has an L-shape, and a lower surface and one side of the rack slidably make contact with the L-shaped guide member.

The driving gear is formed at a circumference thereof with a V-shaped groove which extends to a center of the driving gear, and a circular member for making contact with the third means is integrally formed at one side of the driving gear. The second micro switch is attached to the side wall of the housing and is connected to the control unit, and includes a sensing plate which operates the micro switch when the sensing plate makes contact with the V-shaped groove of the driving gear.

A sensing lever is upwardly and downwardly movable according to an amount of the ice stored in the ice cube storage bin. And, a cam is integrally formed at an end portion of the sensing lever. The cam is a rectangular-shaped plate and is formed at an upper surface thereof with an inclined surface which makes contact with the protruding portion of the rack.

The third micro switch is connected to the control unit and includes a sensing plate which operates the micro switch when the third micro switch makes contact with the lower portion of the cam.

The sensing lever has a first end portion which is integrally formed with the cam and makes contact with the protruding portion of the rack, a second end portion which is opposite to the first end portion and is integrally formed with a bending portion which is downwardly bent and is placed in the ice cube storage bin, and a middle portion formed with a pivot hole through which a pivot pin is penetrated for pivotally fixing the sensing lever to the housing. And, a plate is attached to the bending portion for moving the cam in an upper direction thereof while the ice cubes are being discharged from the ice storage bin, and the plate is provided at a lower portion thereof with a rectangular-shaped protruding piece.

As described above, in the automatic ice maker of a refrigerator according to the present invention, since the automatic ice maker of a refrigerator controls the automatic ice maker by a plurality of switches, it is easy to stably control the automatic ice maker, thereby decreasing the occurrence of a malfunction.

BRIEF DESCRIPTION OF THE DRAWINGS

Other objects, characteristics and advantages of the present invention will become more apparent by describing in detail preferred embodiments thereof with reference to the attached drawings in which.

DETAILED DESCRIPTION OF THE INVENTION

Hereinafter, a preferred embodiment of the present invention will be explained in more detail with reference to the accompanying drawings.

Figure 1:
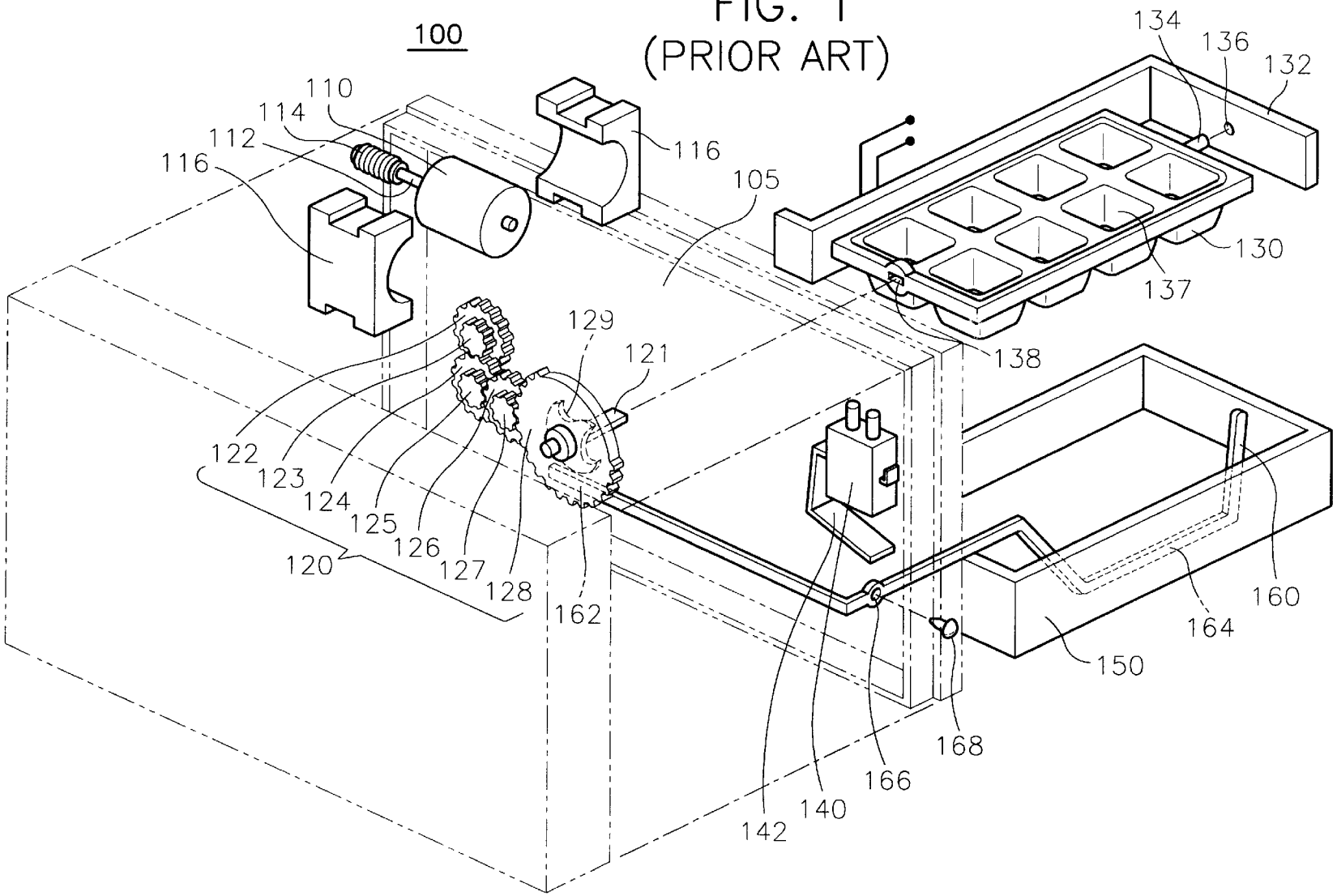
FIG. 1 (PRIOR ART)
FIG. 1 is a perspective view showing an automatic ice maker of a conventional refrigerator.
Figure 2:
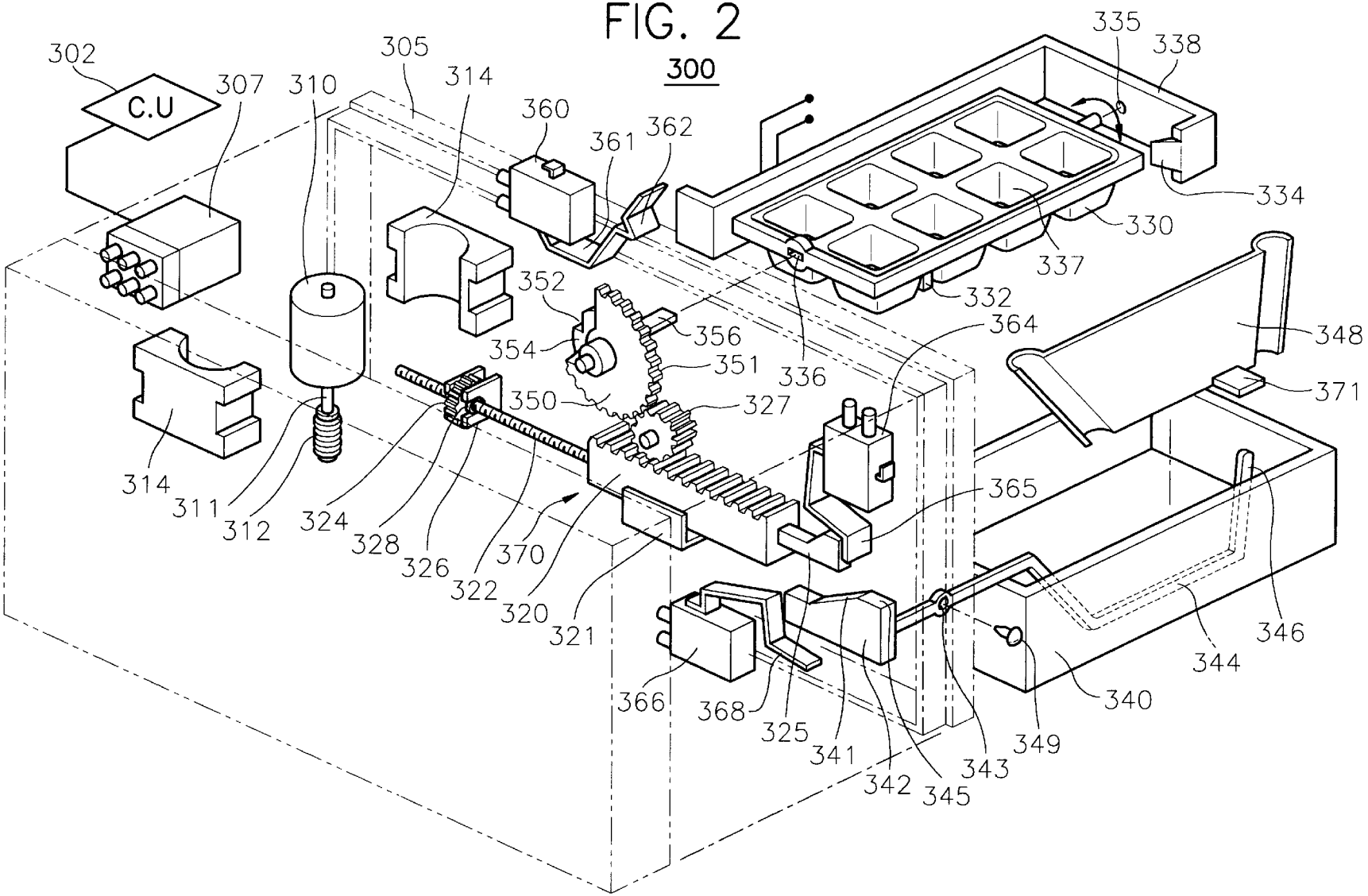
FIG. 2 is an assembly view showing an automatic ice maker of a refrigerator according to the present invention.

FIG. 2 illustrates an automatic ice maker 300 of a refrigerator according to the present invention. As illustrated in FIG. 2, the automatic ice maker 300 of the refrigerator comprises a housing 305, an ice-making container 330 for making an ice by freezing the water, a motor 310 for generating the driving force to drive the ice-making container 330 accommodated in the housing 305, a power transmitting apparatus 370 for transmitting the driving force generated by the motor 310 to the ice-making container 330 so that the ice-making container 330 is inverted or is returned to an original position, a first micro switch 364 for sending a first signal to a control unit 302 for reversing a driving direction of the motor 310 by making contact with the power transmitting apparatus 300, a second micro switch 360 for sending a signal to the control unit 302 for closing the electric power applied to the motor 310 by making contact with the first micro switch 364, and a third micro switch 366 for sensing whether or not an ice cube storage bin 330 which is disposed below the ice-making container is fully filled up with the ice, and for sending a third signal to the control unit 302 for stopping an operation of the ice maker 300 when the ice cube storage bin 330 is fully up with the ice, The motor 310 is fixed to the housing 305 by plurality of a fixing members 314 and is connected to a control unit 302 through a relay 307. The motor 310 is provided with a rotating shaft 311 integrally formed with a worm gear 312 at an end portion thereof.

The power transmitting apparatus 370 comprises a screw shaft 322 for meshing with the worm gear 312 of the motor 310 formed with a worm wheel gear 324 at an end portion thereof, a rack 320 for reciprocating in forward and backward directions according to rotational directions of the screw shaft 322, a pinion gear 327 idly rotated while the rack 320 carries out the reciprocating movement, and a driving gear 350 rotatably meshed with the pinion gear 327 and having a central shaft 356 coupled to the ice-making container 330.

The housing 305 is provided at an inner wall thereof with a pair of supporting brackets 326 which are integrally formed with and protrude from the inner wall, for rotatably supporting the power transmitting apparatus 370. The worm wheel gear 324 is provided between the pair of the supporting brackets 326. A pair of washers 328 are provided between the worm wheel gear 324 and the pair of supporting brackets 326, for facile rotation of the worm wheel gear 324.

Figure 3:
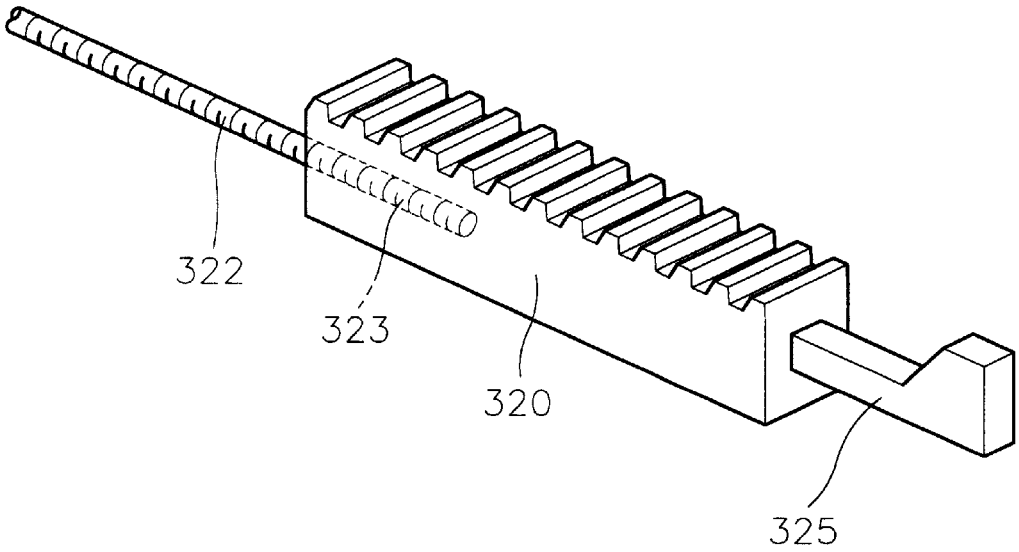
FIG. 3 is an enlarged perspective view showing a rack of the automatic ice maker of the refrigerator according to the present invention.

As illustrated in FIG. 2 and FIG. 3, the rack 320 is formed at an upper portion thereof with a thread 329 meshed with the pinion gear 327, and formed at an inner portion thereof with a hollow 323. A thread 329 is formed on the surface of the hollow 323, and an end portion of the screw shaft 322 is inserted into the hollow 323. The rack 320 is formed at a second portion thereof with a protruding portion 325, and the protruding portion 325 makes contact with a sensing plate 365 provided in the first micro switch 364. The pinion gear 327 is disposed between the rack 320 and the driving gear 350 for idly rotating while the rack 320 carries out the reciprocating movement in a horizontal direction. And, the pinion gear 327 is meshed with the driving gear 350 so as to transmit the driving force to the driving gear 350.

On the other hand, the rack 320 is rotated in an axial direction by means of rotation of the screw shaft 322 during the reciprocating movement. Accordingly, a guide member 321 is provided for preventing the rack 320 from rotating, and the guide member 321 slidably guides the reciprocating movement of the rack 320. The guide member 321 is an L-shaped plate attached to the side surface of the housing 305, and a lower surface and one side of the rack 320 are slidably make contact with the L-shaped guide member 321.

Figure 4:
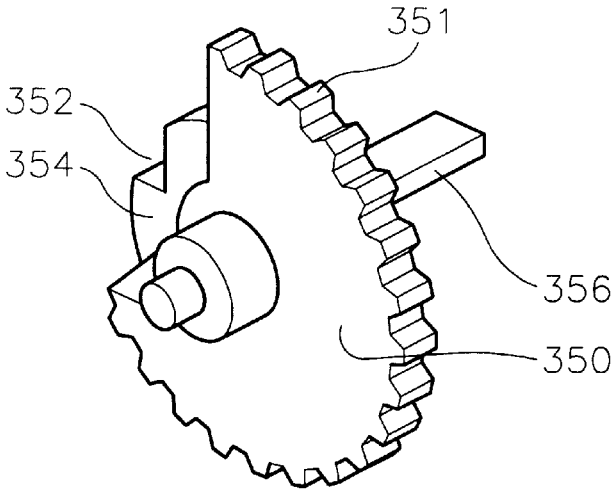
FIG. 4 is an enlarged perspective view showing a driving gear of the automatic ice maker of the refrigerator according to the present invention.

As illustrated in FIG. 2 and FIG. 4, the driving gear 350 transmits the rotating movement of the pinion gear 327 to the ice-making container 330 to overturn the ice-making container 330 or to return it to the initial position. The driving gear 350 is formed at a radial surface thereof with a thread 351 meshing with the pinion gear 327, and is formed at a center thereof with a rotating shaft 356 protrudingly formed from the ice-making container 330. The rotating shaft 356 is coupled to a rectangular-shaped groove 336 formed at the first end portion of the ice-making container 330. And, the rotating shaft 356 has a rectangular shape for preventing the ice-making container from slipping during driving of the driving gear 350. Moreover, the circular member 354 is inserted into the rotating shaft 356 of the driving gear 350. The circular member 354 has a diameter smaller than the diameter of the driving gear 350, and is formed at a circumference portion thereof with a V-shaped groove 352 which extends to a center of the circular member 354. The V-shaped groove 352 of the circular member 354 makes contact with the V-shaped groove formed at a sensing plate 361 provided at a side surface of the second micro switch 360.

When the driving gear 350 is rotated, the circular member 354 is also rotated. At this time, the V-shaped groove 352 of the circular member and the V-shaped groove 362 of the second micro switch 360 are coupled to each other or separated from each other.

Figure 5:
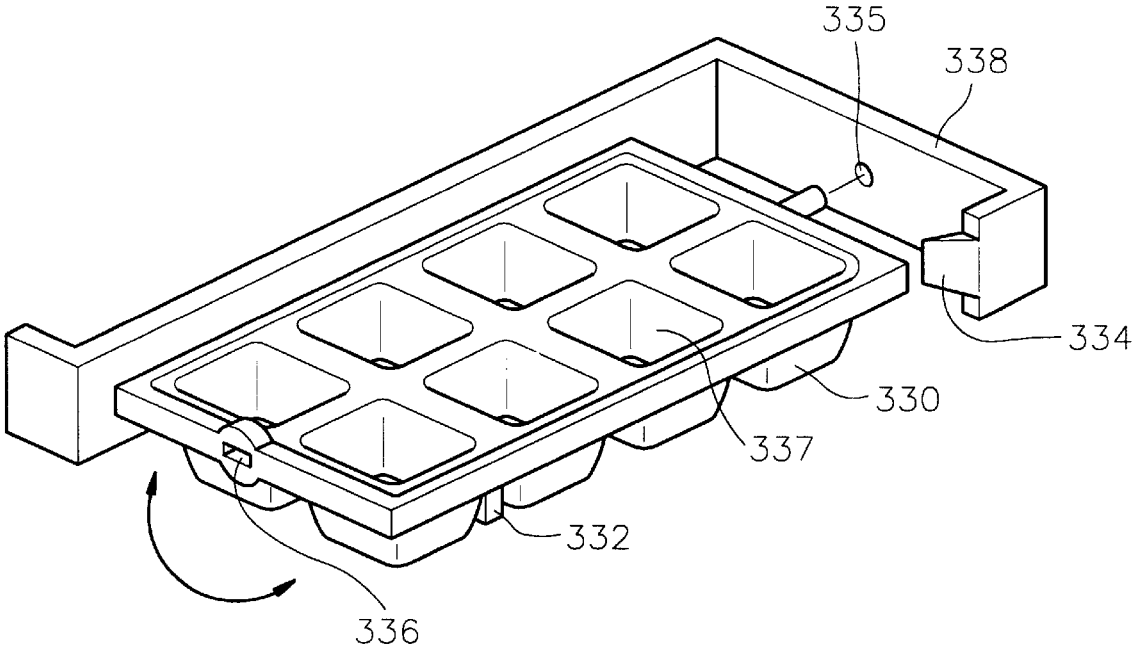
FIG. 5 is an enlarged perspective view showing an ice-making container of the automatic ice maker of the refrigerator according to the present invention.

As illustrated in FIG. 2 and FIG. 5, generally, the ice-making container 330 is a rectangular-shaped vessel and is divided by the compartment 337, for storing the supplied water. A first end portion of the ice-making container 330 is rotatably fixed to the fixing plate 338 fixed to the housing 305 of the automatic ice maker 300. The fixing plate 338 has a first end portion thereof fixed to the body 305, and a second end portion thereof which is integrally formed with a stopper 334. And a coupling hole 335 is formed at a position which is spaced apart from the stopper 334 by a predetermined distance. A rectangular-shaped groove 336 is formed at a second end portion of the ice-making container 330. A sensor for sensing an ice-making is installed at a lower portion of the ice-making container 330.

Figure 6:
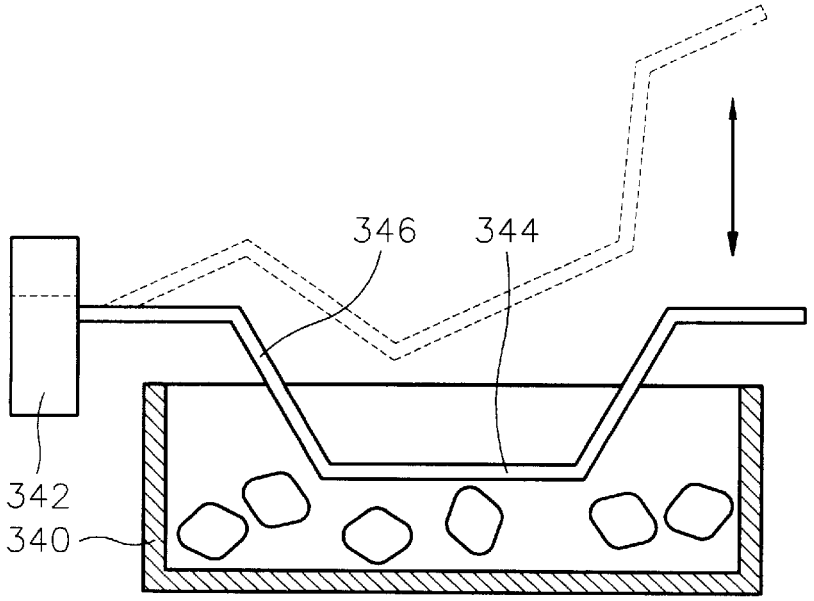
FIG. 6 is a schematic view showing an operating state of a sensing lever of the automatic ice maker according to the present invention.

As illustrated in FIG. 2 and FIG. 6, the sensing lever is an apparatus for sensing whether or not an ice cube storage bin 340 is fully filled up with ice. The sensing lever 346 has a first end portion thereof integrally formed with the cam 342, for making contact with the protruding portion 325 of the rack 320, a second end portion thereof integrally formed with a bending portion 344 which is downwardly bent and is placed in the ice cube storage bin 340, and a middle portion thereof formed with a pivot hole 343 through which a pivot pin 349 is penetrated for pivotally fixing the sensing lever 346 to the housing 305.

The cam 342 is a rectangular plate and is formed at a horizontal surface 345 with an inclined surface 341. The lower surface of the cam 342 makes contact with the sensing plate 368 installed at a side wall of a third micro switch 366.

A plate 348 is attached to the bending portion 344 for moving the cam 342 in an upper direction thereof while the ice is being discharged from the ice storage bin 340. And the plate 348 is provided at a lower portion thereof with a rectangular-shaped protruding piece 371 for widening the contacting area with the ice cubes.

Hereinafter, the function of the ice maker of the refrigerator according to the present invention will be explained.

As illustrated in FIG. 2, first, a water is supplied into an ice-making container 330 fixed to a housing 305 of an automatic ice maker 300. When the water fully fills up the ice-making container 330, a cool air is distributed to an ice-making compartment 302, and then the water becomes ice. At this time, the sensor 332 for sensing the ice-making attached to the ice-making container 330 detects the ice-making, then sends a signal to the central unit 302 for driving a motor 310 so that a rotating shaft 311 of the motor 310 is rotated. Accordingly, a worm wheel gear 324 meshed with the worm gear 312 is rotated, and then a screw shaft 322 integrally formed with the worm gear 312 is rotated. A rack 320 meshing with the screw shaft 322 is moved in a forward direction. The rack 320 is stably moved in a forward direction by a guide member 321 slidably contacting the lower and side surfaces of the rack 320.

At this time, a pinion gear 327 formed on the rack 320 is idly rotated in an anti-clockwise direction, and finally, a driving gear 350 meshed with the pinion gear 327 is rotated in a clockwise direction. Accordingly, the ice-making container 330 coupled with the driving gear 350 by the rotating shaft 356 is overturned in a clockwise direction. When the ice-making container 330 is overturned by 180 degrees, the ice-making container 330 makes contact with the stopper 334 formed at an end portion of the fixing plate 338 fixed to the housing 305. Accordingly, the ice-making container 330 is overturned by a twisting movement, and the ice cubes stored in the ice cube storage bin 340 are discharged therefrom. The discharged ice cubes are stored in the ice cube storage bin disposed below the ice-making container 330. When the ice-making container 330 is overturned by 180 degrees in a clockwise direction, the protruding portion 325 formed at the second end portion of the rack 320 makes contact with the sensing plate 365 installed at the first micro switch 364. At this time, the first micro switch sends the contacting signal to the central unit 302 for reversing a driving direction of the motor 310, so the rack 320 is moved in a backward direction. Then, the pinion gear 327 meshed with the rack 320 is rotated in a clockwise direction. Accordingly, the driving gear 350 meshed with the pinion gear 327 is rotated in an anti-clockwise direction.

Accordingly, the ice-making container 330 overturned by 180 degrees in a clockwise direction is returned to an initial position, and a circular member 354 inserted into the rotating shaft 356 of the driving gear 350 is rotated. At this time, a V-shaped groove 362 formed at the surface of the sensing plate 361 of the second micro switch 360 makes contact with the V-shaped groove 352 formed at the surface of the circumference of the circular member 354. Accordingly, the second micro switch 360 sends the contacting signal to the central unit 302 for stopping the rotation of the motor 310. Then, the water is supplied to the ice-making container 330 again, and the ice-making circle is restarted.

On the other hand, when the rack 320 moves in a forward direction, the protruding portion 325 formed at the second end portion of the rack 320 makes contact with the inclined surface 341 of the cam 342 fixed to the sensing lever 346. Accordingly, the cam 342 is downwardly moved according to the forward movement of the rack 320, and the sensing lever 346 pivotally fixed to the housing is upwardly moved. At this time, the ice cube discharged from the ice-making container 330 is being stored in the ice cube storage bin 340. Accordingly, when the ice cube storage bin is fully filled up, the sensing lever 346 is maintained at the upper portion of the ice cube storage bin 340. The fully filled state of the ice cube storage bin is detected by the protruding piece 371 formed at the lower portion of the sensing lever 346.

The cam 342 connected to the sensing lever 346 is downwardly moved so as to make contact with the sensing plate 368 of the third micro switch 366. The third micro switch 366 sends the contacting signal to the central unit 302 for stopping the automatic ice maker of the refrigerator.

When the ice cubes are discharged from the ice cube storage bin 340, the sensing lever 346 is downwardly moved by the weight of the plate 348 attached to the bending portion of the sensing portion.

As described through the embodiment, since the automatic ice maker of a refrigerator controls the automatic ice maker by the plurality of the switches, it is easy to stably control the automatic ice maker, thereby decreasing the occurrence of a malfunction thereof.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. An automatic ice maker of a refrigerator comprising;

a housing;

an ice-making container for making an ice by freezing the water, the ice-making container being attached to the housing;

a motor for generating the driving force to drive the ice-making container, the motor being accommodated in the housing and having a rotating shaft;

a first means for transmitting the driving force generated by the motor to the ice-making container so that the ice-making container is overturned or is returned to an initial position;

a second means for sending a first signal to a control unit for reversing a driving direction of the motor by making contact with the first means;

a third means for sending a second signal to the control unit for stopping an electric power applied to the motor by making contact with the first means; and a fourth means for sensing whether or not an ice cube storage bin which is disposed below the ice-making container is fully filled up with ice, the fourth means sending a third signal to the control unit for stopping an operation of the ice maker when the ice cube storing bin is fully filled up with the ice.

2. The automatic ice maker of the refrigerator as claimed in claim 1, wherein the first means is mounted at an inner portion of the housing, the first means including a worm gear integrally formed at an end portion of the rotating shaft of the motor, a screw shaft integrally formed at a predetermined portion thereof with a worm wheel gear meshing with the worm gear, a rack coupled to the screw shaft for reciprocating in forward and backward directions according to rotational directions of the screw shaft, a pinion gear disposed on the rack and being meshed with the rack in such a manner that the pinion gear is idly rotated while the rack carries out the reciprocating movement, and a driving gear rotatably meshed with the pinion gear and having a central shaft coupled to the ice-making container.

3. The automatic ice maker of the refrigerator as claimed in claim 2, wherein the rack is formed at an inner portion of a first end thereof with an internal thread and one end of the screw shaft is rotatably meshed with the internal thread.

4. The automatic ice maker of the refrigerator as claimed in claim 2, wherein the housing is provided at an inner wall thereof with a pair of supporting brackets which are integrally formed with protrude from the inner wall for rotatably supporting the first means, the worm wheel gear being provided between the pair of supporting brackets.

5. The automatic ice maker of the refrigerator as claimed in claim 4, wherein a pair of washers are provided between the worm wheel gear and the pair of supporting brackets, for facilitating a rotation of the worm wheel gear.

6. The automatic ice maker of the refrigerator as claimed in claim 2, wherein a protruding portion is formed at a second end portion of the rack which is opposite to the first end portion of the rack, the protruding portion making contact with the second means.

7. The automatic ice maker of the refrigerator as claimed in claim 6, wherein the second means is accommodated in the housing, the second means including a micro switch attached to the side wall of the housing and connected to the control unit, and a sensing plate which operates the micro switch when the sensing plate makes contact with the protruding portion of the rack.

8. The automatic ice maker of the refrigerator as claimed in claim 6, wherein a guide member is fixed to the side wall of the housing for stably guiding the reciprocating movement of the rack.

9. The automatic ice maker of the refrigerator as claimed in claim 8, wherein the guide member has an L-shape, and a lower surface and one side of the rack slidably make contact with the L-shaped guide member.

10. The automatic ice maker of the refrigerator as claimed in claim 6, wherein the driving gear is formed at a circumference thereof with a V-shaped groove which extends to a center of the driving gear, and a circular member for making contact with the third means is integrally formed at one side of the driving gear.

11. The automatic ice maker of the refrigerator as claimed in claim 10, wherein the third means is accommodated in the housing, the third means including a micro switch attached to the side wall of the housing and connected to the control unit, and a sensing plate which operates the micro switch while the sensing plate makes contact with the V-shaped groove of the driving gear.

12. The automatic ice maker of the refrigerator as claimed in claim 6, wherein the fourth means is accommodated in the housing, the fourth means including a sensing lever which is upwardly and downwardly movable according to an amount of the ice stored in the ice cube storage bin, a cam integrally formed at an end portion of the sensing lever, a micro switch connected to the control unit, and a sensing plate which operates the micro switch while the sensing plate makes contact with the lower portion of the cam.

13. The automatic ice maker of the refrigerator as claimed in claim 12, wherein the sensing lever has a first end portion which is integrally formed with the cam and makes contact with the protruding portion of the rack, a second end portion which is opposite to the first end portion and is integrally formed with a bending portion which is downwardly bent and is placed in the ice cube storage bin, and a middle portion formed with a pivot hole through which a pivot pin is penetrated for pivotally fixing the sensing lever to the housing.

14. The automatic ice maker of the refrigerator as claimed in claim 13, wherein the sensing lever has a plate which is attached to the bending portion for moving the cam in an upper direction thereof while the ice is being discharged from the ice storage bin, and the plate is provided at a lower portion thereof with a rectangular-shaped protruding piece.

15. The automatic ice maker of the refrigerator as claimed in claim 12, wherein the cam is a rectangular-shaped plate and is formed at an upper surface thereof with an inclined surface which makes contact with the protruding portion of the rack.

* * * * *